United States Patent [19]

Garganese

[11] Patent Number: 4,697,705

[45] Date of Patent: Oct. 6, 1987

[54] JEWELRY DISPLAY DEVICE

[76] Inventor: Richard S. Garganese, 30 Celestia Ct., North Kingstown, R.I. 02852

[21] Appl. No.: 939,781

[22] Filed: Dec. 9, 1986

[51] Int. Cl.[4] ..... B65D 73/00

[52] U.S. Cl. ..... 206/488; 206/566; D9/457

[58] Field of Search ..... 206/486, 487, 488, 489, 206/566, 45.14; D9/457

[56] References Cited

U.S. PATENT DOCUMENTS

| | | | |
|---|---|---|---|
| D. 264,820 | 6/1982 | Feibelman | D9/457 |
| D. 269,413 | 6/1983 | Jeremiah | D9/457 |
| 4,181,224 | 1/1980 | Aber | 206/566 X |
| 4,332,320 | 6/1982 | Feibelman | 206/487 |
| 4,432,456 | 2/1984 | Ovadia et al. | 206/566 |

*Primary Examiner*—William Price

*Attorney, Agent, or Firm*—Barlow & Barlow, Ltd.

[57] ABSTRACT

A display device for jewelry articles in the form of a card has a plurality of compartments formed therein, one compartment containing the hardware for the jewelry article and the other compartment containing a resilient material. For decorative purposes, the face of the card that covers the open compartment is covered with a flock-like material.

6 Claims, 5 Drawing Figures

JEWELRY DISPLAY DEVICE

BACKGROUND OF THE INVENTION

It has been very common in the Jewelry Industry to utilize what is known as "display cards" to display jewelry articles such as earrings. These cards are generally mounted in groups on a display rack so that articles, such as earrings can be viewed by prospective purchasers. In the Feibelman U.S. Pat. No. 3,568,853, a typical method of mounting of earrings on display cards is illustrated and the manner in which the ultimate display is viewed by the consumer is seen in Feibelman No. 4,175,660. In mounting the jewelry on the display card, it is necessary that an earring, for example, have its stem pass thru an aperture in the card and then, a screw back or clutch back affixes the earring post to the card, which structure is seen in FIG. 2 of patent No. 3,568,853.

This is a very labor intensive operation which increases the cost of merchandising the jewelry articles. In other cases, it has been disclosed to place the jewelry articles in containers as seen in the Feibelman U.S. Pat. No. 4,175,660, but here again the jewelry article must be fastened to the card in some fashion for display. In the hardware field, it has been proposed to have display cards in which the fasteners for the article are separately packaged as, for example, as seen in the Seyforth Pat., U.S. No. 2,858,938.

SUMMARY OF THE INVENTION

The invention provides a display device for jewelry in which the article of jewelry, such as an earring, is held on a card by means of resilient material which grips the pin stem and requires only the pushing of the article of jewelry thru the face of the card, thereby rendering the assembly operation inexpensive insofar as labor costs are concerned and in which the final clutch will be separately packaged in another compartment. The invention provides a display device for jewelry which is compact and which exposes the jewelry for viewing by the customer and which also exposes on the reverse face thereof, the clutches to view and yet firmly holds the jewelry item against loss due to rough handling in transit or on the counter. Various resilient materials which are usable to hold the jewelry item in position, would be a copolymer of styrene and butadiene, hot melt adhesives and nylon, for example.

DESCRIPTION OF THE PREFERRED EMBODIMENT

Figure 1:
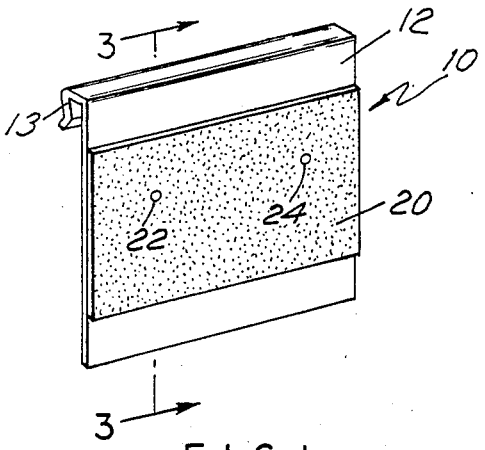
FIG. 1 is a perspective view of a display card made in accordance with the invention.
Figure 2:
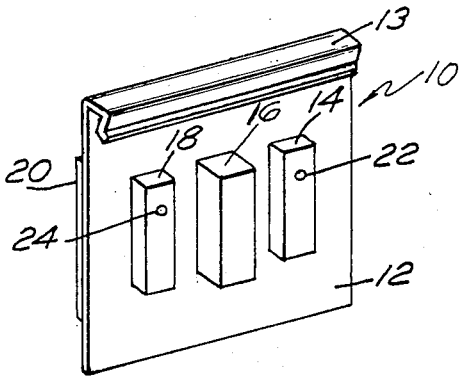
FIG. 2 is a perspective view of the rear face of the jewelry card.

Referring now more particularly to the drawings and the first form of the invention illustrated in FIG. 1, a display card generally indicated 10 has a main plate-like body portion 12 that is molded as seen in FIG. 2 with a plurality of compartments designated 14, 16, and 18.

Figure 3:
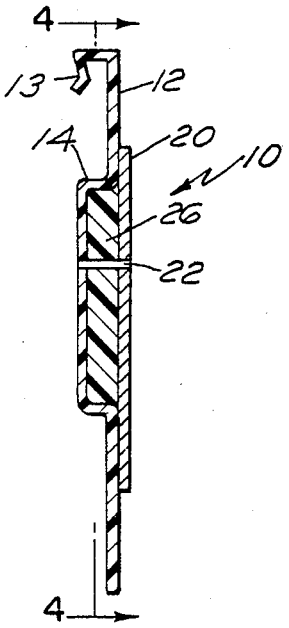
FIG. 3 is an enlarged sectional view taken on line 3—3 of FIG. 1.

Extending from one edge of the card is a hanger member 13. Alternately an aperture (not shown) may be provided to hang the card on a post. Placed on the front face of card 12, is a decorative flocked pad 20 which is attached to the card 12 by an adhesive. In order to provide a suitable means of mounting an earring of the post type, a pair of apertures 22 and 24, are formed thru the flocked pad and the card and, as seen in FIG. 3 pass on thru the back wall of the compartment 14.

To keep the post of an earring, for example, in position, the compartments 14 and 18 are filled with a resilient material, designated 26 that will frictionally grip a post or pin stem. This material may be a polar, thermoplastic polymer, for example a styrene and butadiene exhibiting a Shore hardness between 70–75, which copolymer is essentially a rubber like material. Alternately, the material 24 could be a hot melt adhesive which would be a polar, thermoplastic polymer with tack agents, flexibilizers, plasticizers and stabilizers. In its simplest form this can be also described as an EVA copolymer modified with styrene-butadiene block copolymer and conventionally stabilized for heat, air and light exposure. One form that has been satisfactory is an ethylene vinyl acetate with polyethylene, paraffinic hydrocarbon, hydrocarbon wax and an anti-oxidant. Other materials that will exhibit the properties of friction include thermoset, UV or reaction cure polymers or a nylon or polytetrafluoroethylene having a Shore hardness of 50–60, or equivalent. In addition ethylene vinyl acetate copolymers, ethylene-ethyl acrylate copolymers, polyamides, polyurethane elastomers and polyesters are suitable. The above are purely examples of some of the materials that are usuable.

In essence, the aperture 22 and 24 are made of a diameter less than the diameter of the pin stem which is to pass there thru so that the resilient characteristic of the material 26 will tend to grip the pin stem and hold the same from being withdrawn. It should be understood that the location of the apertures as shown on the drawing is dictated by the style and construction of the article being displayed. For example a dangle earring would have apertures at one end of the compartment.

Figure 5:
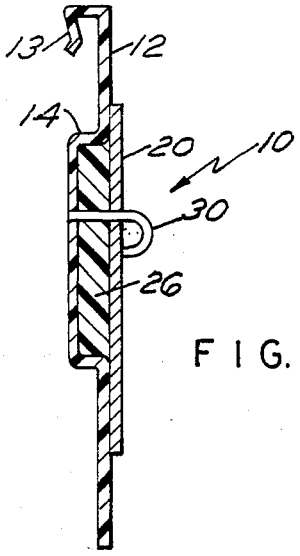
FIG. 5 is a view showing how other articles may be fastened with a staple pin.

Reference is now made to FIG. 5 where an alternate fastening means are illustrated. Here a one-half staple 30 that is in the form of an inverted "J" is utilized for grasping a hoop type earring, for example. Such earrings may be snapped out between the flocked pad 20 and the end of the staple.

Figure 4:
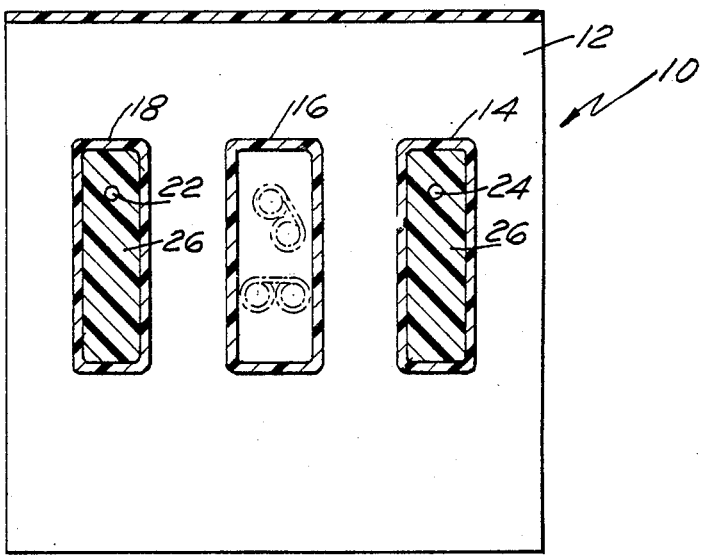
FIG. 4 is a sectional view taken on line 4—4 of FIG. 3.

The consumer's clutch that is used with the earring, for example, or other article of jewelry, can be readily held within the compartment 16 as seen in FIG. 4 so that, when the article is purchased by the consumer, the clutch may be removed from the compartment by peeling back the flocked front.

I claim:

1. A display device for jewelry articles having a pin stem comprising a display card with a plurality of open top compartments formed as an integral part of the display card containing resilient material and of a size sufficient to accomodate placing openings for pin stems at varying locations, a separate compartment containing hardware for the article displayed, a decorative flexible layer overlying the open portion of the compartments in the card, and an opening through the flexible layer and the resilient material of a diameter less than the diameter of the pin stem whereby the pin stem inserted into the opening will be gripped.

2. A device as in claim 1 wherein the resilient material is a base polymer of styrene and butadiene stabilized for heat, air and light exposure and exhibiting a Shore hardness in the range of 70–75.

3. A device as in claim 2 wherein the resilient material is characterized as a hot melt adhesive.

4. A device as in claim 1 wherein the resilient material is nylon.

5. A device as in claim 1 wherein the resilient material is an ethylene vinyl acetate copolymer.

6. A device as in claim 1 wherein the resilient material is a polyurethane elastomer.

* * * * *